US007963282B2

(12) United States Patent
Griffin et al.

(10) Patent No.: US 7,963,282 B2
(45) Date of Patent: Jun. 21, 2011

(54) KITCHEN HOOD ASSEMBLY WITH A COMBINATION CLEANING AND FIRE SUPPRESSION SYSTEM

(75) Inventors: Bill Griffin, Columbia, PA (US); John Staley, Salunga, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 380 days.

(21) Appl. No.: 12/114,382

(22) Filed: May 2, 2008

(65) Prior Publication Data

US 2009/0272372 A1 Nov. 5, 2009

(51) Int. Cl.
*F24C 15/20* (2006.01)

(52) U.S. Cl. ..... 126/299 E; 126/16; 126/299 D; 126/299 R; 126/300; 454/49; 454/53; 454/54; 454/55

(58) Field of Classification Search ..... 126/16, 126/299 D, 299 E, 299 R, 300; 454/49, 53, 454/54, 55

See application file for complete search history.

(56) References Cited

U.S. PATENT DOCUMENTS

| | | | | | |
|---|---|---|---|---|---|
| 3,055,285 | A * | 9/1962 | Gaylord | 126/299 E |
| 3,207,058 | A * | 9/1965 | Gaylord | 126/299 E |
| 3,490,206 | A * | 1/1970 | Doane | 96/228 |
| 3,494,108 | A * | 2/1970 | Moragne | 96/233 |
| 3,564,989 | A * | 2/1971 | Williams et al. | 454/67 |
| 3,805,685 | A * | 4/1974 | Carns | 126/299 E |
| 3,815,625 | A * | 6/1974 | Weise | 137/376 |
| 4,050,446 | A * | 9/1977 | Giuffre | 126/299 E |
| 4,066,064 | A * | 1/1978 | Vandas | 126/299 E |
| 4,085,735 | A * | 4/1978 | Kaufman et al. | 126/299 E |
| 4,231,769 | A * | 11/1980 | Ahlrich | 96/229 |
| 4,363,642 | A | 12/1982 | Stahl | |
| 4,784,114 | A * | 11/1988 | Muckler et al. | 126/299 E |
| 5,042,457 | A * | 8/1991 | Gallagher | 126/299 E |
| 5,642,784 | A | 7/1997 | Guay et al. | |
| 5,662,097 | A * | 9/1997 | Panos | 126/299 E |
| 6,079,502 | A * | 6/2000 | Davis et al. | 169/61 |
| 6,125,841 | A * | 10/2000 | Boudreault | 126/299 D |
| 6,162,286 | A | 12/2000 | Hasama et al. | |
| 6,170,480 | B1 * | 1/2001 | Melink et al. | 126/299 R |
| 6,817,356 | B2 * | 11/2004 | Gallagher | 126/299 E |
| 2002/0028501 | A1 | 3/2002 | McMinn, Jr. | |
| 2005/0178378 | A1 * | 8/2005 | Marshall et al. | 126/299 D |
| 2008/0135041 | A1 * | 6/2008 | Robison | 126/299 D |

FOREIGN PATENT DOCUMENTS

| | | | |
|---|---|---|---|
| FR | 2865419 | A1 * | 7/2005 |
| WO | 2008035064 | | 3/2008 |

* cited by examiner

*Primary Examiner* — Kenneth B Rinehart
*Assistant Examiner* — Jorge Pereiro
(74) *Attorney, Agent, or Firm* — Coats & Bennett, P.L.L.C.

(57) ABSTRACT

A kitchen hood assembly includes a combination hood cleaning and fire suppression system. The hood assembly includes a hood structure and a riser connected thereto. An exhaust blower forces an exhaust stream of air into the hood and through the riser. A combination hood cleaning and fire suppression system is incorporated into the hood structure. The combination hood cleaning and fire suppression system includes an elongated spray bar that is connected to a water source and includes a surfactant injector that injects a surfactant into the water being directed to the spray bar. In one mode of operation, the spray bar is effective to clean the hood assembly. In another mode of operation, when a fire is sensed in or in the vicinity of the hood, the same spray bar is utilized to inject an aqueous liquid into the hood to suppress the fire.

2 Claims, 8 Drawing Sheets

KITCHEN HOOD ASSEMBLY WITH A COMBINATION CLEANING AND FIRE SUPPRESSION SYSTEM

FIELD OF THE INVENTION

The present invention relates to cleaning and suppressing fires in kitchen hood assemblies.

SUMMARY OF THE INVENTION

A kitchen hood assembly is provided and includes a combination cleaning and fire suppression system. That is, the hood assembly is operative in one mode to inject water or an aqueous solution into the hood structure to clean the same. In a second mode of operation, in response to a fire being detected in or adjacent to the hood, the same system injects water or an aqueous solution into the hood to suppress a fire.

In one embodiment, the kitchen hood assembly comprises a combination hood cleaning and fire suppression system. This hood assembly includes a hood structure and a riser connected to the hood structure and extending therefrom. An exhaust blower is provided for forcing an exhaust stream of air into and through the riser. The combination hood cleaning and fire suppression system incorporated into the hood structure is adapted in a cleaning mode to spray water and a surfactant within the kitchen hood to clean the same, and in a fire suppression mode in response to a signal from a fire sensor, spray water and a surfactant into the kitchen hood to know down and suppress the fire.

Other objects and advantages of the present invention will become apparent and obvious from a study of the following description and the accompanying drawings which are merely illustrative of such invention

DESCRIPTION OF THE INVENTION

Figure 1:
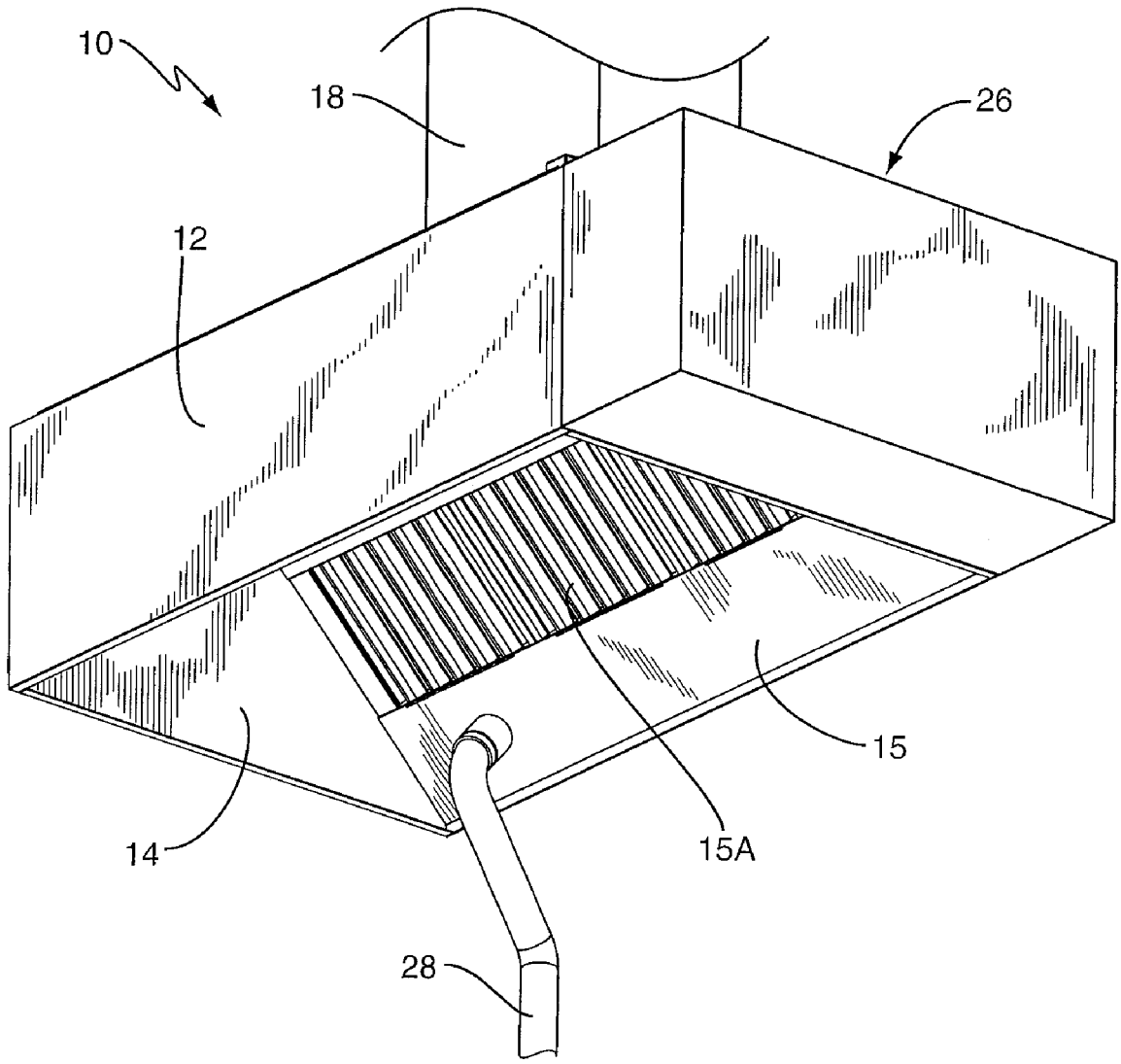
FIG. 1 is a perspective view of the kitchen hood assembly with the combination cleaning and fire suppression system.
Figure 2:
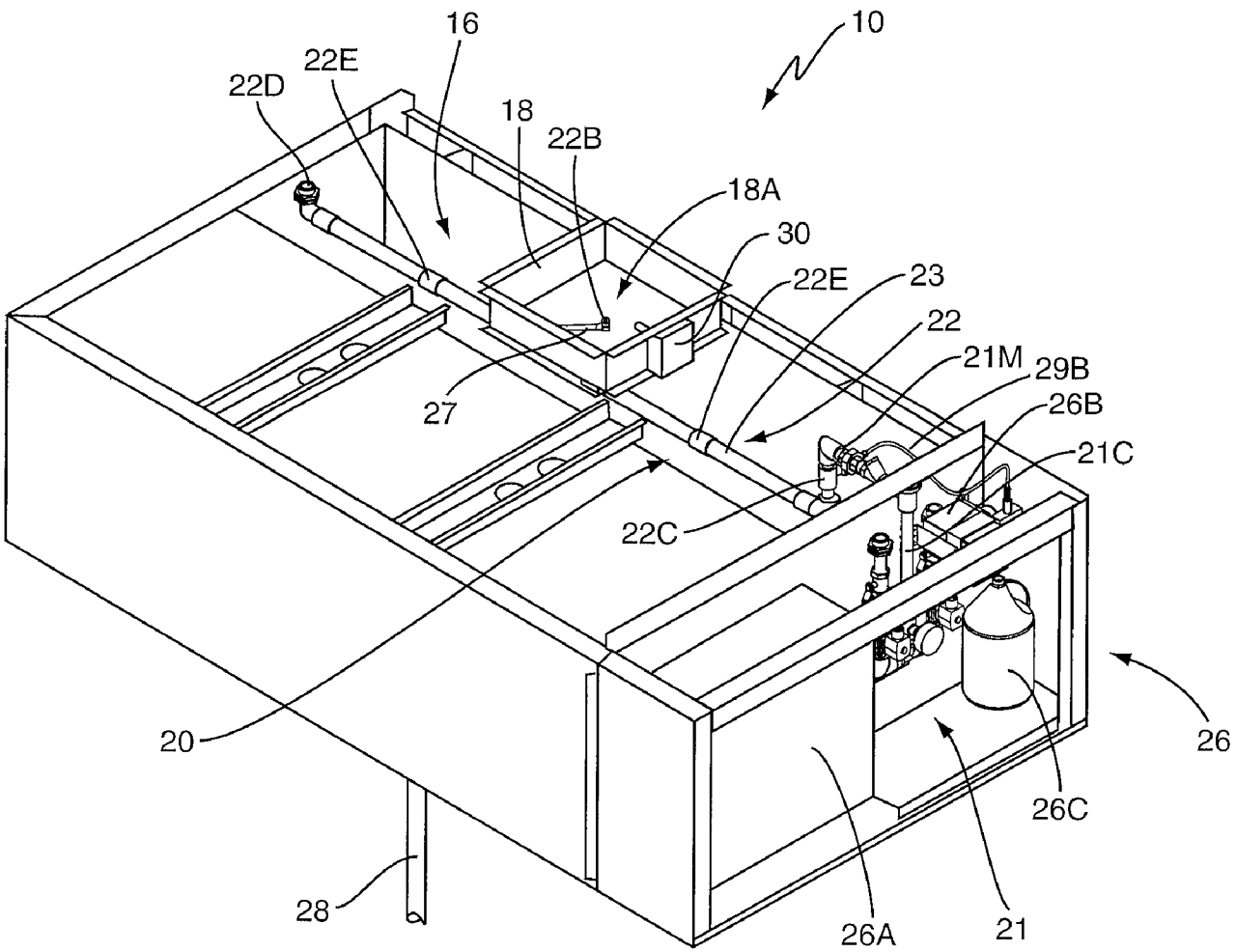
FIG. 2 is a perspective of the kitchen hood assembly with a top portion thereof removed to better illustrate the combination cleaning and fire suppression system.

With further reference to the drawings, the kitchen hood assembly of the present invention is shown therein and indicated generally by the numeral 10. As illustrated in FIG. 1, kitchen hood assembly 10 comprises a housing 12 generally defining the outer structure. Disposed within hood assembly 10 is a combination cleaning and fire suppression system 20 comprising a spray bar 22 and a control system 26 as shown in FIGS. 2, 3, and 4.

Figure 4:
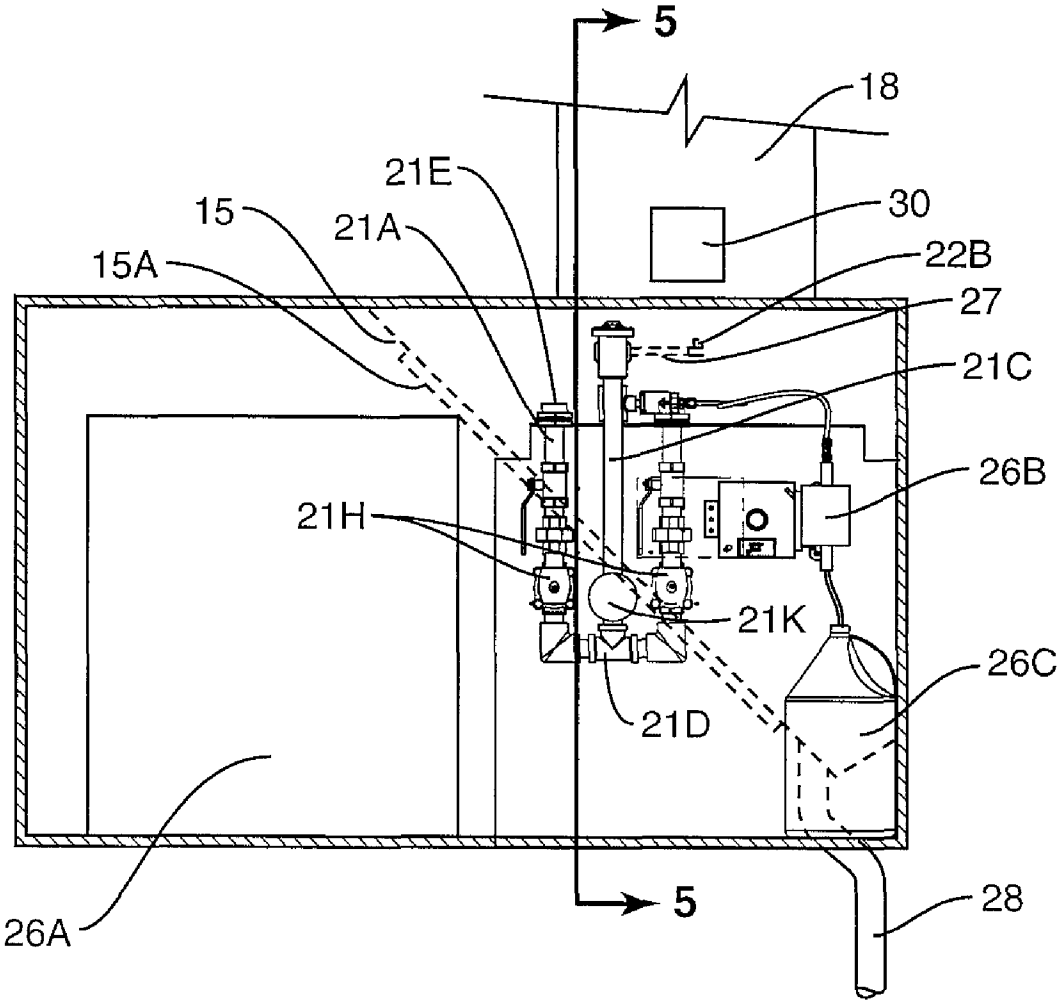
FIG. 4 is a side sectional view of the kitchen hood assembly taken through the line 4-4 of FIG. 3.
Figure 4A:
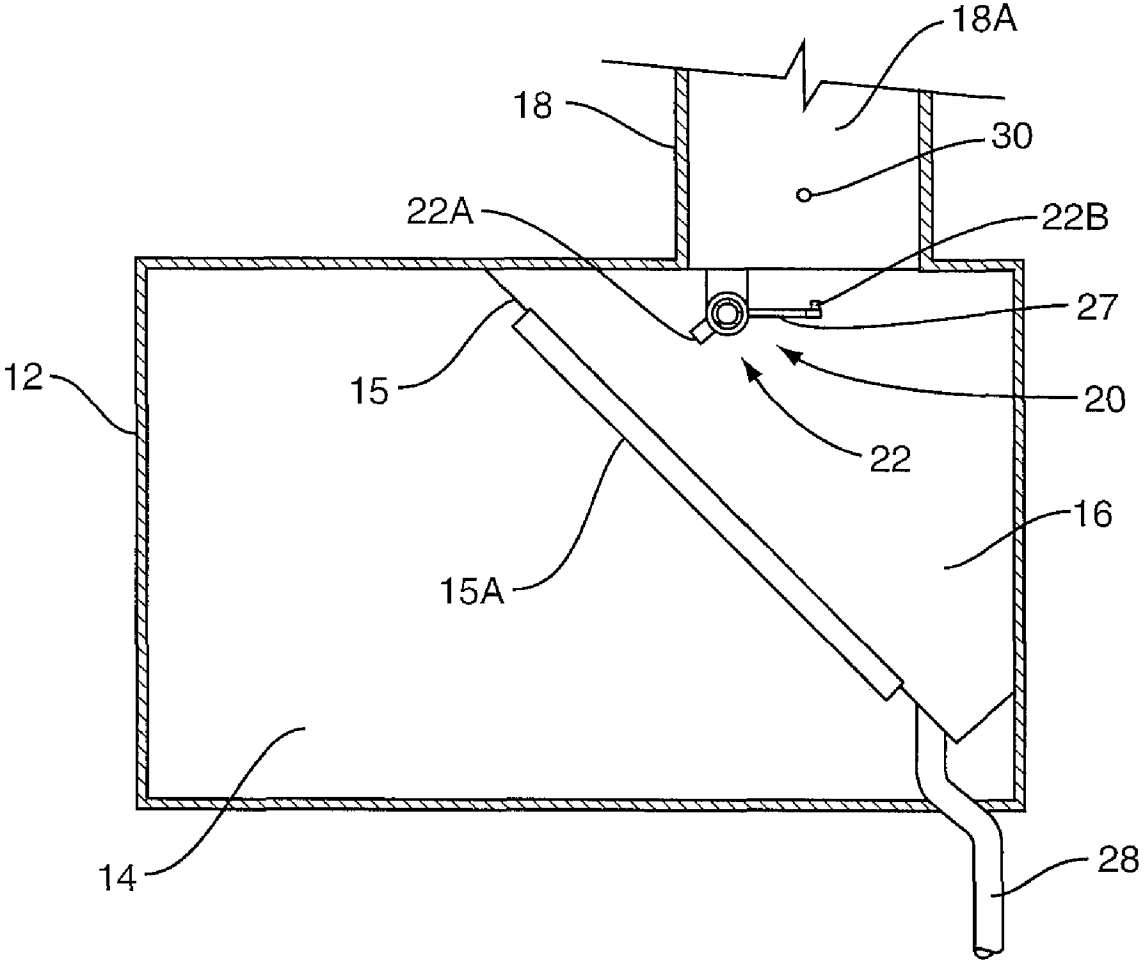
FIG. 4A is a side sectional view of the kitchen hood assembly taken through the line 4A-4A of FIG. 3.
Figure 5:
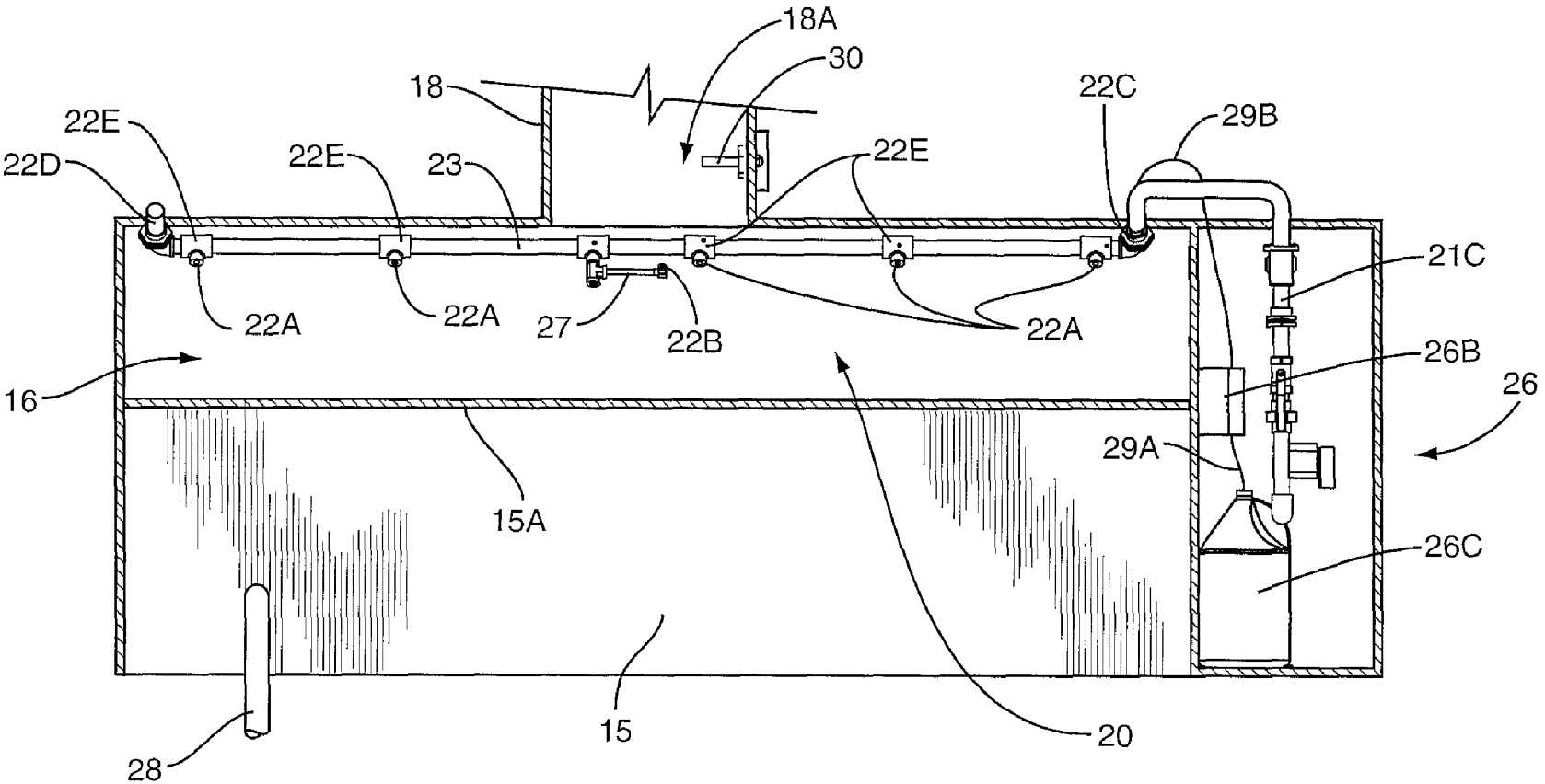
FIG. 5 is a front sectional view of the kitchen hood assembly with the combination cleaning and fire suppression system.

Turning now to a more detailed description of kitchen hood assembly 10, housing 12 encloses a vapor entrainment area 14 comprising a portion of the interior of the housing as illustrated in FIG. 1. In a typical application, kitchen hood assembly 10 is mounted such that it is spaced above a cooking surface or similar device in order that vapors produced in cooking are entrained upwards into vapor entrainment area 14. Kitchen hood assembly 10 includes a grease confinement area 16 that is separated from vapor entrainment area 14 by an inclined panel 15 as shown particularly in FIGS. 2 and 4A. Mounted within panel 15 is a filter 15A through which the entrained vapors may flow into grease confinement area 16. Mounted to an upper portion of hood assembly 10 and in fluid communication with grease confinement area 16 is a riser or duct 18 extending away from the hood assembly. Riser 18 includes an interior 18A to receive vapors from grease confinement area 16 and conduct the vapors away from hood assembly 10. An exhaust blower is disposed in fluid communication with riser 18. The exhaust blower maintains a draft through riser 18 to facilitate entraining vapor in vapor entrainment area 14 and directing the vapors through filter 15A into grease confinement area 16 and subsequently through riser 18 to be exhausted away from hood assembly 10.

Disposed within grease confinement area 16 is a portion of the combination cleaning and fire suppression system 20. Spray bar 22 extends generally transversely across an upper portion of the grease confinement area 16. See FIGS. 2 and 3. Spray bar 22 includes a series of spaced-apart nozzles 22A and at least one riser nozzle 22B. Nozzles 22A are typically angled to direct spray to the inner surfaces of the grease confinement area 16. Nozzles 22A may, however, be directed at various angles and all nozzles need not be directed in the same direction. Each nozzle 22A has a spray pattern, spacing, and direction such that a spray of an appropriately pressurized aqueous liquid, such as water and a surfactant, from the nozzles impinges on the interior surfaces of grease confinement area 16 to remove contaminants, including grease and generally clean the hood in this area. At least one nozzle 22B is positioned to align with the center of the horizontal cross-section of riser 18. See FIGS. 2, 3, and 4A. Nozzle 22B is directed generally upward such that a spray of an appropriately pressurized liquid from the nozzle is directed into the center of riser 18.

Figure 3:
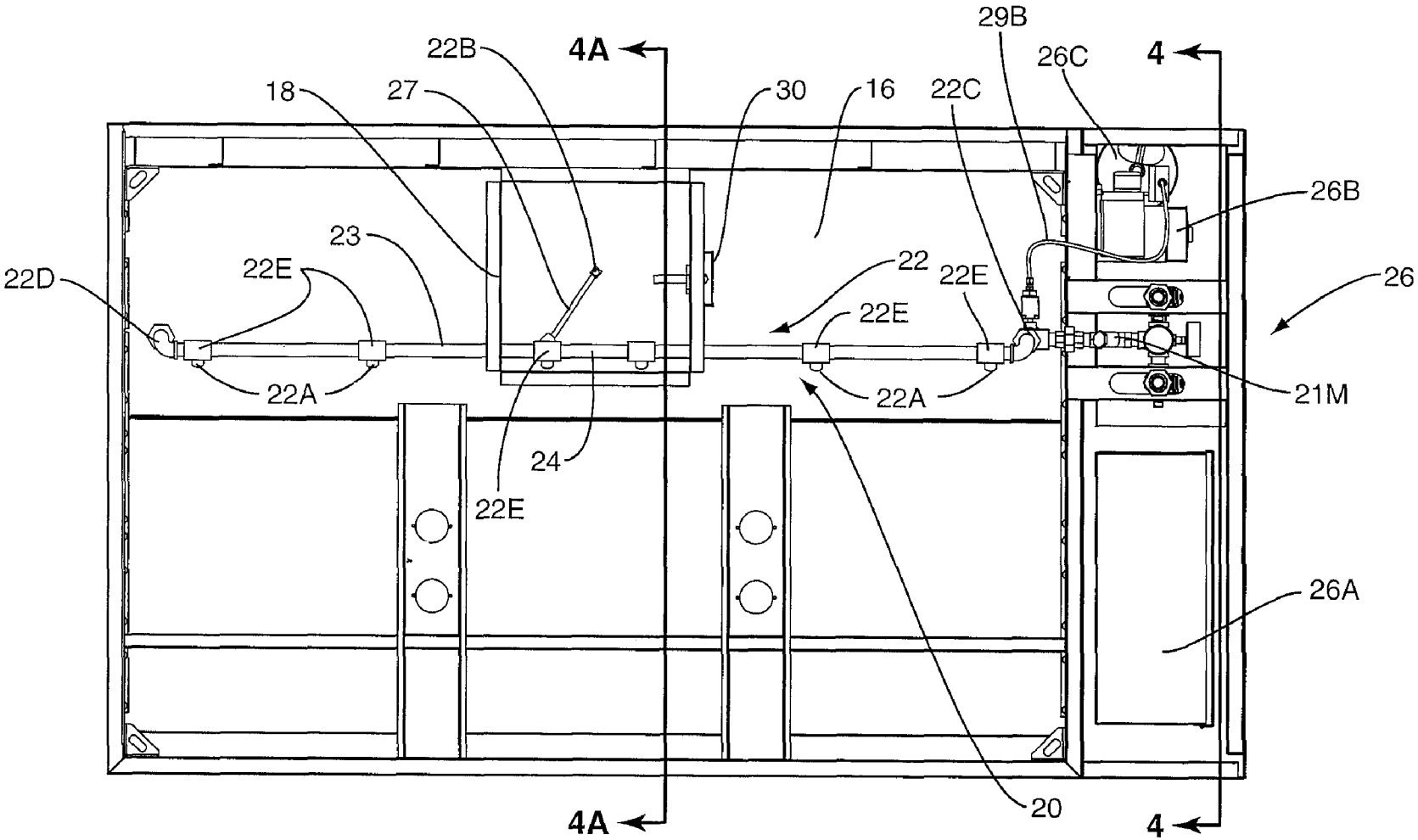
FIG. 3 is a top plan view of the kitchen hood with a top portion removed to better illustrate internal components of the hood.

In one embodiment, spray bar 22 includes a series of pipe segments 23 connected together by a series of tees 22E as illustrated particularly in FIG. 3. Nozzles 22A and 22B are associated with the tees 22E. Note that the riser nozzle 22B is generally oriented in position to direct an aqueous liquid into the riser 18. Spray bar 22 in the embodiment illustrated in FIG. 3 is offset with respect to the center of riser 18. In order to position nozzle 22B generally centrally with respect to the riser 18, there is provided an arm 27 that extends between the tee 22E and the nozzle 22B.

Figure 6:
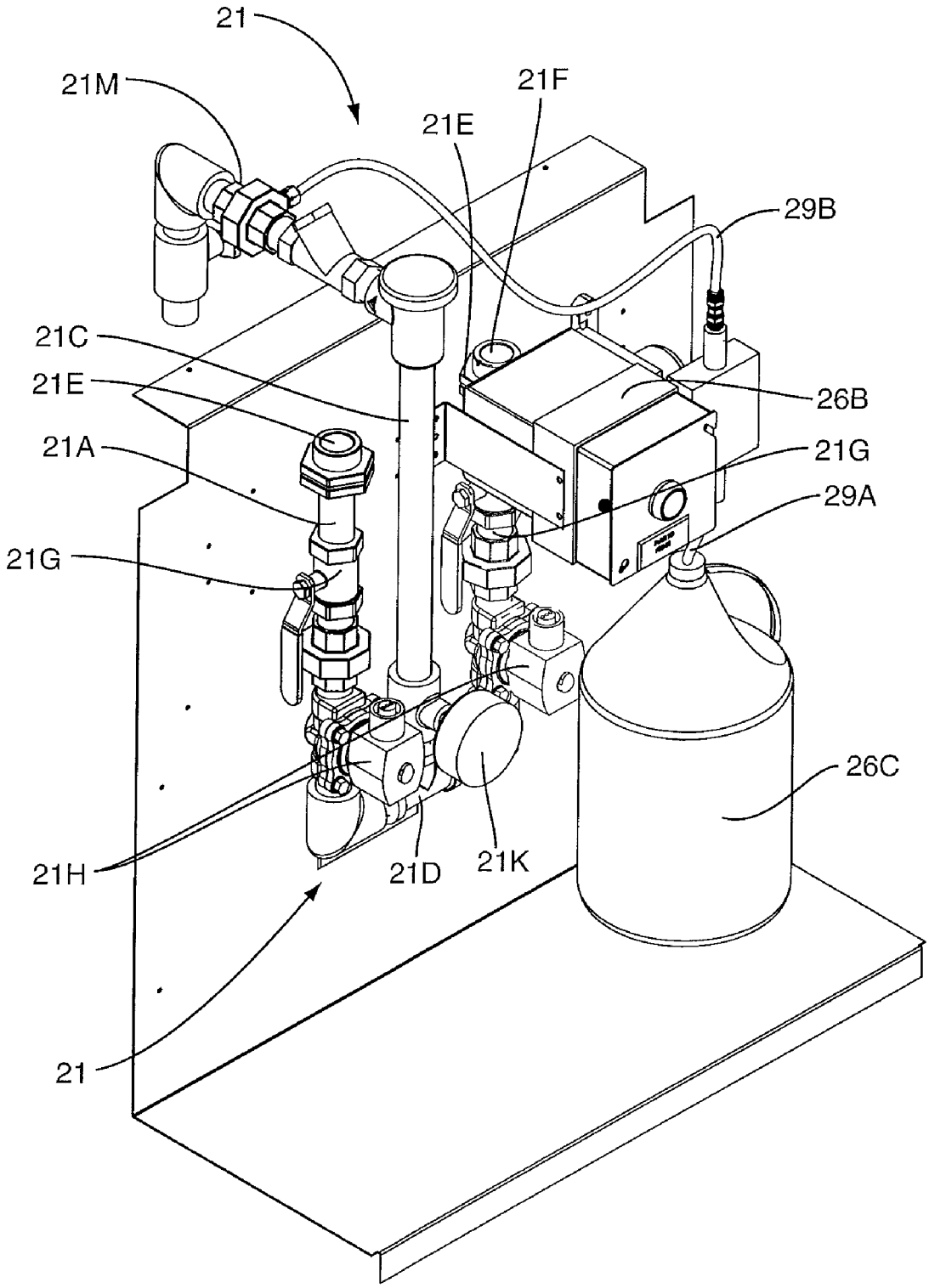
FIG. 6 is a fragmentary perspective view of the kitchen hood assembly showing the control system.

Turning now to control system 26 (FIG. 6), the control system includes a manifold 21 (FIG. 6) for connecting spray bar 22 to a source of water, a surfactant controller 26B, and a surfactant reservoir 26C. Manifold 21 is constructed generally of pipe and fittings by common methods. The configuration of manifold 21, in one embodiment, includes a pair of vertically-oriented tubular inlet legs 21A, 21B and a vertical tubular outlet leg 21C (FIG. 6). The vertically-oriented legs 21A, 21B, 21C are connected and in fluid communication with a horizontal connector 21D. Water from two sources may thus be provided to manifold 21. For example, heated water may be directed into inlet 21E of leg 21A and unheated water may be directed into inlet 21F of leg 21B. The heated and unheated water is directed through manual shut-off valves 21G (one in each of legs 21A, 21B) and electronic solenoid valves 21H (one in each of legs 21A, 21B) into connector 21D from whence the mixed heated and unheated water is directed into leg 21C and into spray bar 22. It is noted that spray bar 22 is in fluid communication with leg 21C by an upper connector 21M.

As noted above, each leg 21A, 21B includes a manual shutoff valve 21G and an electric solenoid valve 21H. Leg 21C includes a temperature sensor 21K. Control system 26 may include the capacity to respond to a desired temperature set point and adjust the flow of heated and unheated water to obtain and maintain the temperature of the water flowing in leg 21C at a certain temperature or within a temperature range.

Control system 26 also includes a surfactant injection apparatus to inject surfactant into the water directed to spray bar 22. In one embodiment, the apparatus includes a surfactant pump system 26B and a surfactant reservoir 26C. The pump inlet is fluidly connected to reservoir 26C by tube 29A, and the pump outlet is connected to connector 21M by tube 29B. It is appreciated that a check valve may be interposed between the connection of tube 29B to connector 21M and surfactant pump system 26B to prevent backflow through the surfactant pump system.

Control system 26 further includes commonly known circuitry and logic for activating system 20 by admitting supply water into the system for a set or desired time period. During the time period that water is being injected into cleaning and fire suppression system 20, control system 26 controls the amount of surfactant injected by surfactant pump 26B.

The cleaning and fire suppression system 20 further includes a fire sensor 30 that is mounted on riser 18, or in an area in the hood, such that the sensor is operative to be activated by a fire in interior 18A of the riser 18 or grease confinement area 16. In one embodiment, fire sensor 30 includes an active sensing element extending at least partially into interior 18A. Fire sensor 30 may be of various extant designs that provide an electrical signal that may be used to initiate operation of combination cleaning and fire suppression system 20 in the event of a fire being detected as will be discussed here below.

Figure 7:
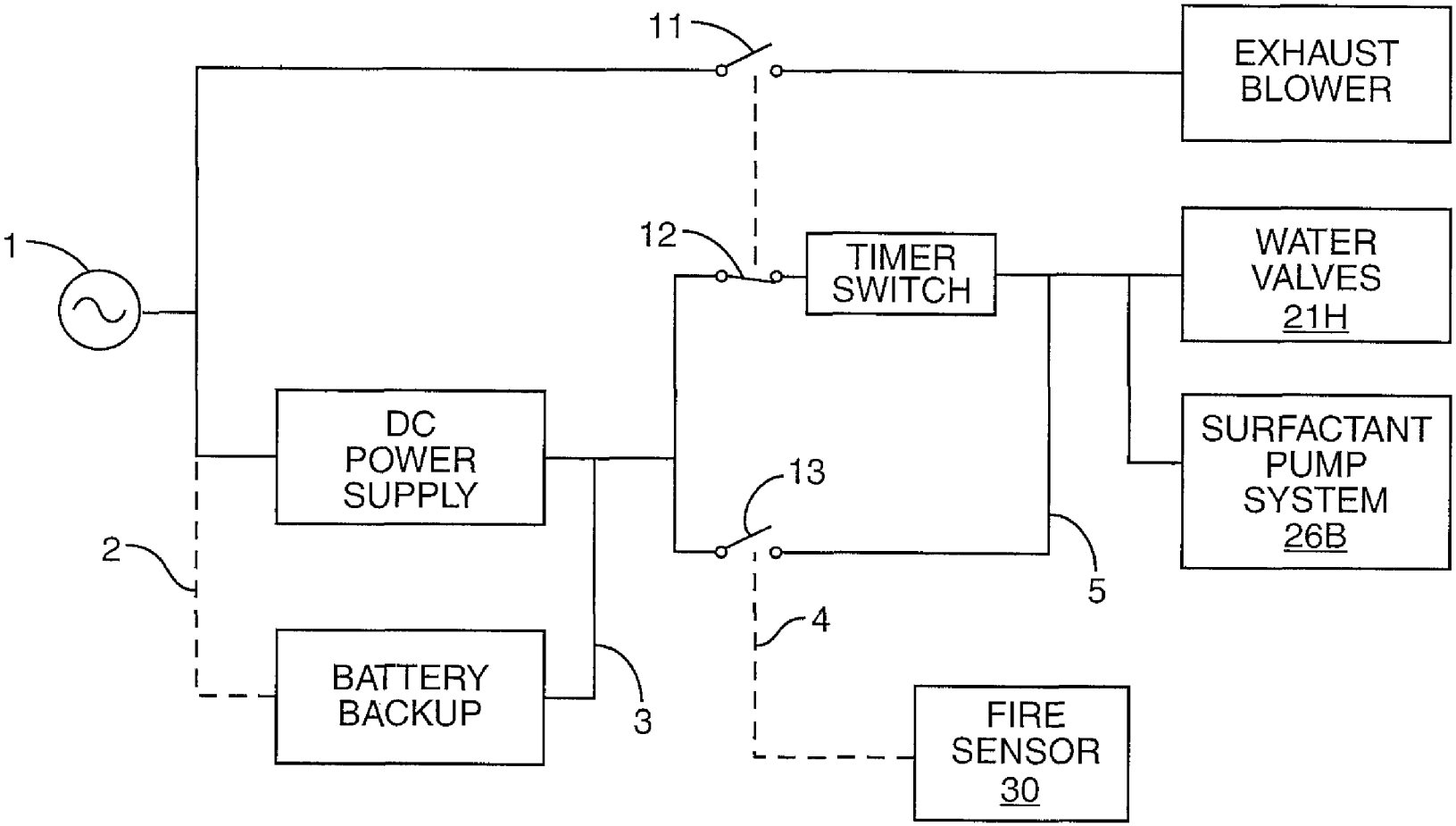
FIG. 7 is a schematic illustration of the control system.

A control schematic for control system 26 that enables both hood cleaning and fire suppression is illustrated in FIG. 7. Components that make-up the controls may, in one embodiment, be housed within control system cabinet 26A (FIG. 2). The elements include an uninterruptible power supply or battery back up device that is operable to automatically maintain power to the system during a power outage. Electrical power from AC supply 1 is supplied to a DC power supply which in turn provides DC electrical power for control system 26. Typically, the hood exhaust blower is powered by an AC motor and is controlled by a manual shut-off switch 11. Also typically, the control elements require DC electrical power that may be provided by the DC power supply and battery back-up device. The battery back-up device includes the capability to sense the state of AC supply 1, that capability indicated by dashed line 2. When a power outage is detected, the battery back-up supplies via line 3 the DC power to maintain operation of cleaning and fire suppression system 20 during the power outage. Exhaust blower shut-off switch 11, which generally is a manually actuated on-off switch, is coupled to a wash switch 12 such that closing switch 11 opens switch 12, and opening switch 11 closes switch 12. The coupling of switches 11 and 12 may be of various known forms including a mechanical linkage and electrical relays. With switches 11 and 12 thus coupled, when the exhaust blower is operating, cleaning with cleaning and fire suppression system 20 is not normally energized. This is the normal operation of hood 10 in which, for example, cooking of foods is occurring under or near the hood. The exhaust blower may be de-energized by manually opening switch 11 as would, for example, be the case at the end of a cooking period. When switch 11 is opened, switch 12 closes and energizes water valves 21H to admit water into manifold 21 and surfactant pump system 26B to provide surfactant such that cleaning and fire suppression system 20 performs a cleaning cycle for range hood assembly 10. In one embodiment, a timer switch is provided in series with switch 12 and is operable to de-energize water valves 21H and surfactant pump 26B upon completing a desired or set cleaning period. In the example just discussed, the power supply is DC. However, it is appreciated that AC power could be used to power the control system 26 shown in FIG. 7. Various components of the system would be changed to make them AC compatible. Further, a back-up power source, such as an AC generator, could be used.

Fire sensor 30 is coupled to a fire switch 13, the coupling symbolically indicated in FIG. 7 by dashed line 4. When a fire in range hood 10 occurs, fire sensor 30 closes fire switch 13 to energize water valves 21H and surfactant pump 26B. Line 5 connects to switch 13 and effectively interconnects the DC power supply and battery back-up to the water valves 21H and surfactant pump system 26B. This connection by-passes switch 12 and the timer switch. Whether the exhaust blower is energized or not, should a fire be sensed by fire sensor 30, fire switch 13 closes and energizes valves 21H and pump system 26B for fire suppression. Thus energized, water and surfactant is sprayed into hood assembly 10, including into riser 18, to suppress the fire. A manual reset feature of common design may be provided to de-energize cleaning and fire suppression system 20 when the fire is suppressed. Alternatively, when the level of fire suppression is such that fire sensor 30 no longer senses a fire, switch 13 may be configured to open and de-energize valves 21H and surfactant pump system 26B.

It is appreciated that cleaning and fire suppression system 20 functions similarly during cleaning and fire suppression. Once energized, whether by manual shut-off of hood assembly 10 or by a fire being sensed by fire sensor 30, system 20 functions the same way using the same aqueous liquid.

To be effective in cleaning hood assembly 10, cleaning and fire suppression system 20 may be supplied with water having a temperature between about 140° F. and about 170° F. To be effective in cleaning and fire suppression, water pressure may be maintained at about 30 psi. Nozzles 22A can provide a flow of about 0.7 gpm at 30 psi. Riser nozzle 22B may be rated to provide 2.4 gpm at 30 psi. In a typical application, nozzles 22A are equivalent to Macola Model No. 2591 or 2592 and nozzles 22B are equivalent to Macola Model No. 2593. All plumbing is brass pipe or tube. Spray bar 22 comprises ¾" pipe nipples 23 and 24, tees 22E, and elbows. Riser nipple 27 comprises ¼" tubing or pipe and commonly available fittings to connect to spray bar 22. In a typical application, pipe nipples 23 are about 12" long and provide for nozzles 22A to be spaced apart about 13" and preferably spaced at between 12½" and 13½". It is appreciated that all of these sizes discussed above can vary and will probably vary depending upon application. Fire suppression sensor 30 should be of a design capable of sensing the presence of fire typical of range hood systems. Fire sensors are well known in the art and are commercially available. Hood drain 28 is typically formed of brass pipe and fittings. In one embodiment, 1½" pipe is used in forming hood drain 28, and the hood drain extends at least 72" away from hood assembly 10.

Commonly available surfactants may be used and function also as detergents. Generally, during cleaning or fire suppression, control system 26 provides for surfactant to be injected for 1 second for every minute of operation. The surfactant is effective in the fire suppression mode to knockdown the fire. The amount of surfactant administered during a fire and the time period for injecting a surfactant can vary. However, in a preferred design and process, surfactant is continuously injected into the water stream in a fire situation.

There are many advantages to the new kitchen hood assembly of the present invention. One principal advantage is that the kitchen hood assembly utilizes substantially the same structure and system for both cleaning the hood assembly and for fire prevention. Also, it should be pointed out that the kitchen hood assembly disclosed herein and the fire proof prevention system is fully certified to Standard UL300.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A kitchen hood assembly having a combination hood cleaning and fire suppression system, comprising:

1. a kitchen hood for mounting above a cooking surface, the kitchen hood including:
   a. a housing having an interior enclosed about a top and sides thereof and open about a bottom thereof;
   b. an open space and a grease confinement space in the interior of the housing with the grease confinement space separated from the open space by a filter and connected to a hood drain for draining fluid from the grease confinement space;
   c. an exhaust riser connected to the housing and secured thereto so as to be in fluid communication with the grease confinement area;
   d. wherein the exhaust riser includes a horizontal cross section having a center;
   e. an exhaust blower connected to the exhaust riser and upon activation maintains a draft through the exhaust riser for entraining vapor arising, at least, from the cooking surface above which the kitchen hood is mounted; and
   f. an exhaust blower control switch for turning the exhaust blower on or off;
2. a spray bar including:
   a. an elongated main conduit mounted in the grease confinement space and extending through the greases confinement space;
   b. wherein the elongated main conduit is horizontally offset from the center of the horizontal cross section of the exhaust riser;
   c. a series of nozzles spaced along the elongated main conduit with each nozzle being mounted on the elongated main conduit and in fluid communication with the elongated main conduit such that when a fluid is directed into the elongated main conduit at least a portion of the fluid is sprayed through the nozzles into the grease confinement space;
   d. a horizontally directed conduit secured to and supported by the elongated main conduit and extending generally horizontally from the elongated main conduit and through a portion of the grease confinement area;
   e. a riser nozzle mounted to the horizontally directed conduit and in fluid communication with the elongated main conduit;
   f. wherein the elongated main conduit, horizontally directed conduit and riser nozzle are oriented such that the riser nozzle is directed towards the exhaust riser such that at least a portion of the fluid directed through the elongated main conduit is directed through the horizontally directed conduit and through the riser nozzle and upwardly into the exhaust riser;
3. a fire sensor disposed adjacent the riser;
4. a control system that in one mode of operation actuates the hood cleaning and fire suppression system for cleaning the kitchen hood and in another mode of operation, in response to a signal from the fire sensor, actuates the hood cleaning and fire suppression system to suppress a fire; and
5. wherein in both modes of operation fluid is directed through the elongated main conduit, through the horizontally directed conduit, out the nozzles disposed on the main elongated conduit and out the riser nozzle.

2. The kitchen hood assembly of claim 1 wherein the horizontally directed conduit is secured to the main conduit such that the horizontally directed conduit may be angled in a general horizontal plane for orienting the riser nozzle generally centrally with respect to the exhaust riser.

* * * * *